US012006584B2

(12) United States Patent
Kondoh et al.

(10) Patent No.: US 12,006,584 B2
(45) Date of Patent: Jun. 11, 2024

(54) FILM FORMATION APPARATUS AND FILM FORMATION METHOD FOR FORMING METAL FILM

(71) Applicant: TOYOTA JIDOSHA KABUSHIKI KAISHA, Toyota (JP)

(72) Inventors: Haruki Kondoh, Okazaki (JP); Koji Inagaki, Toyota (JP); Keiji Kuroda, Toyota (JP); Kazuaki Okamoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 16 days.

(21) Appl. No.: 17/931,965

(22) Filed: Sep. 14, 2022

(65) Prior Publication Data

US 2023/0124546 A1 Apr. 20, 2023

(30) Foreign Application Priority Data

Oct. 15, 2021 (JP) ..... 2021-169934

(51) Int. Cl.

| | |
|---|---|
| ***C25D 17/10*** | (2006.01) |
| ***C25D 17/00*** | (2006.01) |
| ***C25D 17/04*** | (2006.01) |
| ***C25D 21/02*** | (2006.01) |
| ***C25D 21/12*** | (2006.01) |

(52) U.S. Cl.

CPC ..... *C25D 17/10* (2013.01); *C25D 17/002* (2013.01); *C25D 17/04* (2013.01); *C25D 21/02* (2013.01); *C25D 21/12* (2013.01)

(58) Field of Classification Search

CPC ..... C25D 17/002

See application file for complete search history.

(56) References Cited

U.S. PATENT DOCUMENTS

2015/0329982 A1* 11/2015 Miura ..... C25D 7/0607 204/232

2016/0265126 A1 9/2016 Hiraoka et al.

FOREIGN PATENT DOCUMENTS

JP 2016169399 A 9/2016

* cited by examiner

*Primary Examiner* — Hosung Chung

(74) *Attorney, Agent, or Firm* — Dickinson Wright, PLLC

(57) ABSTRACT

A film formation apparatus includes an anode, a solid electrolyte membrane between the anode and a substrate, a power supply that applies voltage between the anode and the substrate as a cathode, and a liquid reservoir that holds the anode and the solid electrolyte membrane while separating them apart from each other, the liquid reservoir storing electrolyte solution including metal ions between the anode and the solid electrolyte membrane. The solid electrolyte membrane includes a central portion that comes in contact with the substrate and the electrolyte solution, and an outer edge portion outside the central portion. The apparatus includes a membrane tensioning mechanism to apply a tensile force to the central portion toward the outer edge portion while storing the heated electrolyte solution in the liquid reservoir, to elongate the central portion.

5 Claims, 7 Drawing Sheets

FILM FORMATION APPARATUS AND FILM FORMATION METHOD FOR FORMING METAL FILM

CROSS REFERENCE TO RELATED APPLICATIONS

The present application claims priority from Japanese patent application JP 2021-169934 filed on Oct. 15, 2021, the entire content of which is hereby incorporated by reference into this application.

BACKGROUND

Technical Field

The present disclosure relates to film formation apparatuses to form a metal film on the surface of a substrate and such film formation methods.

Background Art

Conventionally, metal films have been formed by depositing metal ions on the surface of a substrate (e.g., JP 2016-169399 A). JP 2016-169399 A describes a film formation apparatus for forming a metal film. The apparatus includes an anode, a solid electrolyte membrane placed between the anode and a substrate serving as a cathode, a power supply to apply a voltage between the anode and the substrate, and a liquid reservoir storing electrolyte solution containing metal ions between the anode and the solid electrolyte membrane.

This film formation apparatus includes a casing, in which the solid electrolyte membrane and the anode are placed away from each other. The casing, the solid electrolyte membrane, and the anode make up the liquid reservoir. The electrolyte solution in this liquid reservoir comes into direct contact with the anode and the solid electrolyte membrane.

For formation of a metal film with this film formation apparatus, the solid electrolyte membrane is brought into contact with the substrate from above, and then the electrolyte solution is poured into the liquid reservoir of the casing, followed by the application of a voltage between the anode and the substrate from the power supply. As a result, the metal ions contained in the solid electrolyte membrane are reduced on the surface of the substrate, thus depositing metals on the surface of the substrate to form a metal film.

SUMMARY

When a metal film is formed using the above-mentioned film formation apparatus, heated electrolyte solution may be poured into the liquid reservoir for reasons such as increasing the film forming speed. In this case, the solid electrolyte membrane thermally expands under the influence of heat from the electrolyte solution. This thermal expansion may cause the solid electrolyte membrane to sag against the surface of the substrate. A voltage applied between the anode and the substrate while having the solid electrolyte membrane sagging causes unevenness on the surface of the solid electrolyte membrane, which accordingly causes unevenness on the surface of the metal film, and degrades the appearance of the metal film.

In view of this, the present disclosure provides a film formation apparatus and film formation method for forming a metal film that suppresses unevenness on the surface of the metal film and thus improves the film forming quality.

In view of the above problems, a film formation apparatus for forming a metal film according to the present disclosure includes: an anode; a solid electrolyte membrane disposed between the anode and a substrate; a power supply that applies a voltage between the anode and the substrate serving as a cathode; and a liquid reservoir that holds the anode and the solid electrolyte membrane while separating the anode and the solid electrolyte membrane apart from each other, the liquid reservoir storing an electrolyte solution including metal ions between the anode and the solid electrolyte membrane, the film formation apparatus being configured to apply a voltage between the anode and the substrate while allowing the solid electrolyte membrane to be in contact with the substrate to reduce the metal ions in the solid electrolyte membrane, and form the metal film on a surface of the substrate. The solid electrolyte membrane includes a central portion, which is a portion that comes into contact with the substrate and the electrolyte solution, and an outer edge portion located outside the central portion. The film formation apparatus further includes a membrane tensioning mechanism configured to apply a tensile force from the central portion toward the outer edge portion while storing the heated electrolyte solution in the liquid reservoir, to elongate the central portion of the solid electrolyte membrane.

According to the present disclosure, the film formation apparatus includes the membrane tensioning mechanism configured to apply a tensile force from the central portion toward the outer edge portion while storing the heated electrolyte solution in the liquid reservoir, to elongate the central portion of the solid electrolyte membrane. Therefore, even when the solid electrolyte membrane thermally expands due to heated electrolyte solution poured into the liquid reservoir, which causes sagging of the solid electrolyte membrane against the surface of the substrate, the tensile force applied by the membrane tensioning mechanism from the central portion toward the outer edge portion elongates the central portion of the solid electrolyte membrane. As a result, this film formation apparatus applies a voltage between the anode and the substrate after eliminating the sagging of the solid electrolyte membrane, that is, while keeping the solid electrolyte membrane flat. This suppresses unevenness in the metal film deposited on the surface of the substrate, and thereby suppresses fluctuations in film thickness of the metal film.

As a preferable configuration, the membrane tensioning mechanism at least includes: a frame that sandwiches the outer edge portion, which is bent along an outer side face of the liquid reservoir, with the outer side face; and a tensioning device configured to slide the frame along the outer side face so as to apply the tensile force to the central portion. According to such a configuration, when the frame is slid along the outer side face by the tensioning device, the outer edge portion of the solid electrolyte membrane moves uniformly by the frictional force with the frame. Accordingly, an isotropic tensile force acts on the central portion of the solid electrolyte membrane, stretching the central portion outward, which elongates the central portion more uniformly. This forms a smooth metal film because a voltage can be applied between the anode and the substrate after correcting the sagging in the solid electrolyte membrane due to thermal expansion.

As a preferable configuration, the membrane tensioning mechanism at least includes: a winder, around which the outer edge portion of the solid electrolyte membrane is partially wound; and a tensioning device configured to rotate the winder while allowing the outer edge portion to be in contact with the winder so as to apply the tensile force to the central portion. According to such a configuration, the rotation of the winder by the tensioning device winds the outer edge portion of the solid electrolyte membrane partially around the winder due to the frictional force with the winder. This causes the central portion of the solid electrolyte membrane to be stretched outward for elongation. This forms a smooth metal film because a voltage can be applied between the anode and the substrate after correcting the sagging in the solid electrolyte membrane due to thermal expansion.

As a preferable configuration, the membrane tensioning mechanism at least includes: a membrane support that supports the outer edge portion of the solid electrolyte membrane; a rod member that abuts on the outer edge portion and is movable in the film thickness direction of the solid electrolyte membrane relative to the solid electrolyte membrane; and a tensioning device configured to move the rod member in the film thickness direction while the outer edge portion is supported by the membrane support, thus applying a tensile force to the central portion. According to such a configuration, when the rod member is moved in the film thickness direction by the tensioning device, the outer edge portion of the solid electrolyte membrane is pushed by the rod member while being supported by the membrane support. This causes the central portion of the solid electrolyte membrane to be stretched outward for elongation. This forms a smooth metal film because a voltage can be applied between the anode and the substrate after correcting the sagging in the solid electrolyte membrane due to thermal expansion.

As a preferable configuration, the film formation apparatus further includes: a first temperature sensor that detects the first temperature of the solid electrolyte membrane; a second temperature sensor that detects the second temperature of the substrate; a third temperature sensor that detects the third temperature of the electrolyte solution; and a controller programmed to receive the first temperature information from the first temperature sensor, the second temperature information from the second temperature sensor, and the third temperature information from the third temperature sensor when the liquid reservoir stores the electrolyte solution, and control the membrane tensioning mechanism to operate if the first temperature information, the second temperature information, and the third temperature information are within a predetermined range. According to such a configuration, even when thermal expansion of the solid electrolyte membrane causes sagging, the controller controls the membrane tensioning mechanism to operate if the temperatures of the solid electrolyte membrane, the substrate, and the electrolyte solution are within a predetermined range. This allows the membrane tensioning mechanism to apply a tensile force from the central portion of the solid electrolyte membrane toward the outer edge portion, so as to elongate the central portion of the solid electrolyte membrane. In this way, when the temperature difference between the solid electrolyte membrane, the substrate, and the electrolyte solution becomes small or when they have no temperature difference, in other words, when it is determined that additional sagging of the solid electrolyte membrane is unlikely to occur due to such a temperature difference, this configuration makes the membrane tensioning mechanism elongate the central portion of the solid electrolyte membrane. This forms a smoother metal film because a voltage can be applied between the anode and the substrate after correcting the sagging in the solid electrolyte membrane due to thermal expansion.

The present disclosure further provides a film formation method for forming a metal film. A film formation method according to the present disclosure forms a metal film on a surface of a substrate, a voltage is applied between an anode and the substrate serving as a cathode while pressing the substrate with a solid electrolyte membrane under liquid pressure of an electrolyte solution to reduce metal ions contained in the solid electrolyte membrane. The method includes: bringing the solid electrolyte membrane into contact with a surface of the substrate; pouring the electrolyte solution that is heated between the anode and the solid electrolyte membrane; keeping the electrolyte solution stored, and stretching the solid electrolyte membrane by applying a tensile force from a central portion, which is a portion of the solid electrolyte membrane that comes into contact with the substrate and the electrolyte solution, toward an outer edge portion located outside of the central portion, to elongate the central portion of the solid electrolyte membrane; and pressing the substrate with the stretched solid electrolyte membrane under liquid pressure of the stored electrolyte solution, and applying a voltage between the anode and the substrate to form the metal film.

According to such a configuration of the present disclosure, the method includes keeping the heated electrolyte solution stored, and stretching the solid electrolyte membrane by applying a tensile force from a central portion, which is a portion of the solid electrolyte membrane that comes into contact with the substrate and the electrolyte solution, toward an outer edge portion located outside of the central portion, to elongate the central portion of the solid electrolyte membrane. Therefore, even when the solid electrolyte membrane thermally expands due to heated electrolyte solution poured into the space between the anode and the solid electrolyte membrane, which causes sagging of the solid electrolyte membrane against the surface of the substrate, the tensile force applied from the central portion toward the outer edge portion elongates the central portion of the solid electrolyte membrane. As a result, this film formation method applies a voltage between the anode and the substrate after eliminating the sagging of the solid electrolyte membrane, that is, while keeping the solid electrolyte membrane flat. This suppresses unevenness in the metal film deposited on the surface of the substrate, and thereby suppresses fluctuations in film thickness of the metal film.

As a preferable configuration, the step of stretching the solid electrolyte membrane includes sandwiching the outer edge portion, which is bent along an outer side face of a liquid reservoir storing the electrolyte solution, between a frame disposed to at least partially surround the outer edge portion and the outer side face of the liquid reservoir, and sliding the frame along the outer side face so as to apply a tensile force to the central portion. According to such a configuration, when the frame slides along the outer side face, the outer edge portion of the solid electrolyte membrane moves uniformly by the frictional force with the frame. Accordingly, an isotropic tensile force acts on the central portion of the solid electrolyte membrane, stretching the central portion outward, which elongates the central portion more uniformly. This forms a smooth metal film because a voltage can be applied between the anode and the substrate after correcting the sagging in the solid electrolyte membrane due to thermal expansion.

As a preferable configuration, the step of stretching the solid electrolyte membrane includes bringing the outer edge portion into contact with a winder, around which the outer edge portion is partially wound; and rotating the winder so as to apply the tensile force to the central portion. According to such a configuration, the rotation of the winder winds the outer edge portion of the solid electrolyte membrane partially around the winder due to the frictional force with the winder. This causes the central portion of the solid electrolyte membrane to be stretched outward for elongation. This forms a smooth metal film because a voltage can be applied between the anode and the substrate after correcting the sagging in the solid electrolyte membrane due to thermal expansion.

As a preferable configuration, the step of stretching the solid electrolyte membrane includes: while allowing a membrane support to support the outer edge portion of the solid electrolyte membrane, moving a rod member in a film thickness direction of the solid electrolyte membrane, the rod member being movable in the film thickness direction relative to the solid electrolyte membrane, thus applying a tensile force to the central portion. According to such a configuration, when the rod member moves in the film thickness direction, the outer edge portion of the solid electrolyte membrane is pushed by the rod member while being supported by the membrane support. This causes the central portion of the solid electrolyte membrane to be stretched outward for elongation. This forms a smooth metal film because a voltage can be applied between the anode and the substrate after correcting the sagging in the solid electrolyte membrane due to thermal expansion.

As a preferable configuration, the step of stretching the solid electrolyte membrane includes: when the electrolyte solution is stored between the anode and the solid electrolyte membrane, applying a tensile force to the central portion if a temperature of the solid electrolyte membrane, a temperature of the substrate, and a temperature of the electrolyte solution are within a predetermined range. According to such a configuration, even when thermal expansion of the solid electrolyte membrane causes sagging, the method applies a tensile force to the central portion to elongate the central portion if the temperatures of the solid electrolyte membrane, the substrate, and the electrolyte solution are within a predetermined range. In this way, when the temperature difference between the solid electrolyte membrane, the substrate, and the electrolyte solution becomes small or when they have no temperature difference, in other words, when it is determined that additional sagging of the solid electrolyte membrane is unlikely to occur due to such a temperature difference, this configuration elongates the central portion of the solid electrolyte membrane. This forms a smoother metal film because a voltage can be applied between the anode and the substrate after correcting the sagging in the solid electrolyte membrane due to thermal expansion.

The present disclosure suppresses unevenness on the surface of a metal film.

DETAILED DESCRIPTION

The following describes a film formation apparatus capable of implementing a metal-film formation method according to one embodiment of the present disclosure.

First Embodiment

Figure 1:
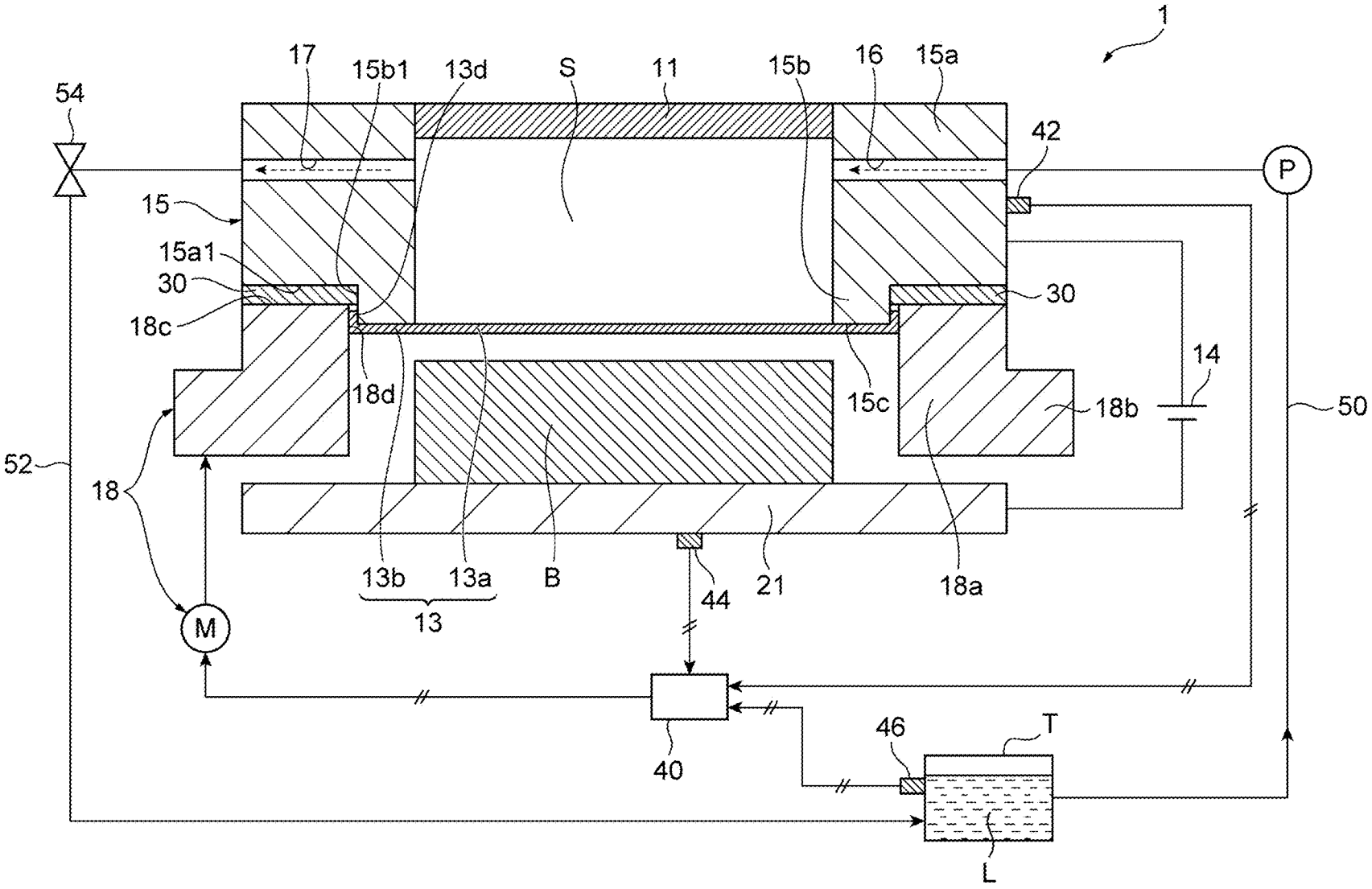
FIG. 1 is a schematic cross-sectional view of a film formation apparatus of metal film according to a first embodiment of the present disclosure.
Figure 2:
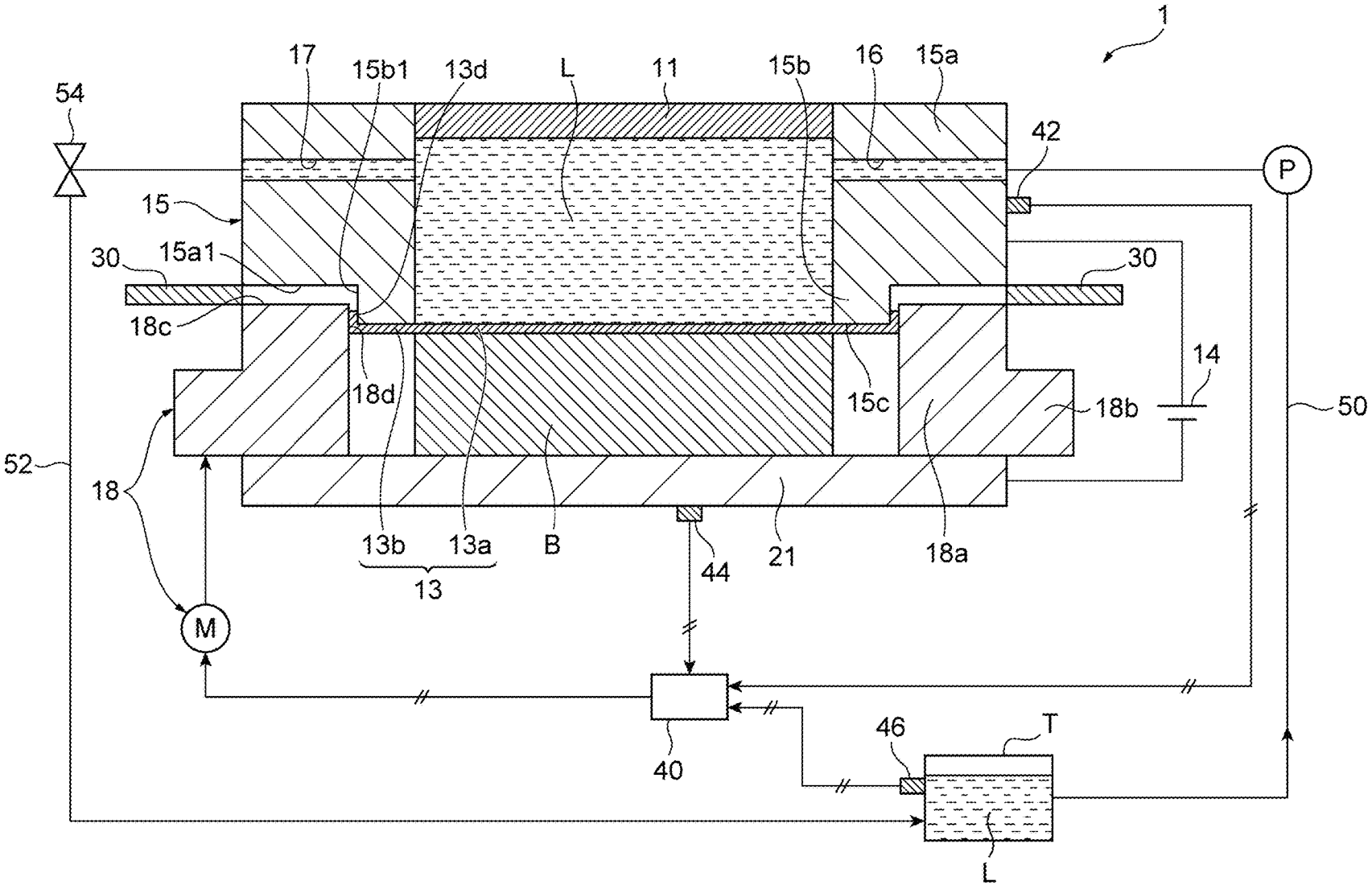
FIG. 2 is a schematic cross-sectional view of the film formation apparatus shown in FIG. 1, showing the electrolyte solution stored in the apparatus.
Figure 3:
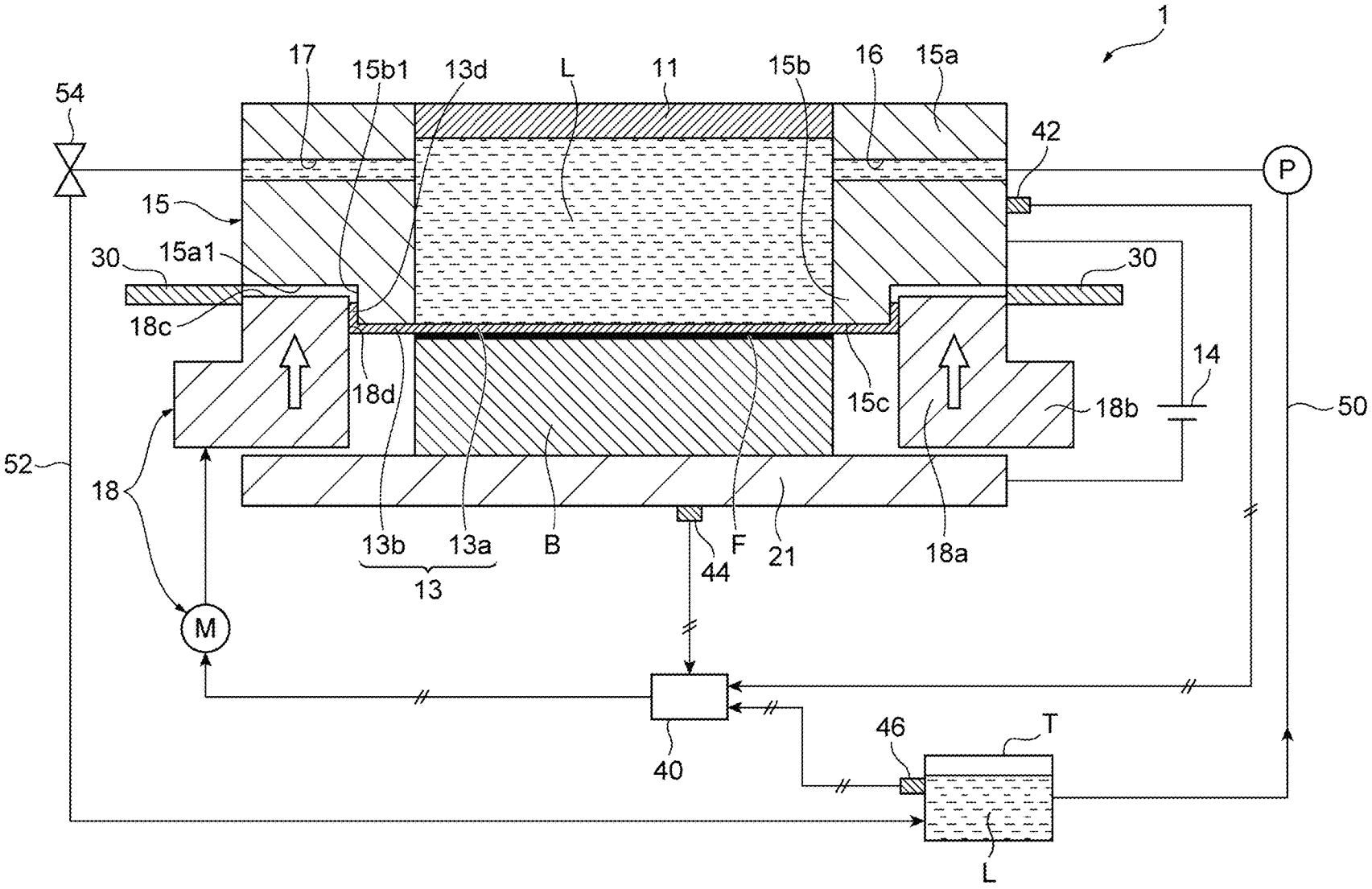
FIG. 3 is a schematic cross-sectional view of the film formation apparatus shown in FIG. 1, showing the solid electrolyte membrane stretched outward.

FIG. 1 is a schematic cross-sectional view of a film formation apparatus 1 to form a metal film F according to a first embodiment of the present disclosure. FIG. 2 is a schematic cross-sectional view of the film formation apparatus 1 shown in FIG. 1, showing the electrolyte solution L stored in the apparatus. FIG. 3 is a schematic cross-sectional view of the film formation apparatus 1 shown in FIG. 1, showing the solid electrolyte membrane 13 stretched outward.

As shown in FIGS. 1 to 3, the film formation apparatus 1 includes an anode 11 made of metal, a solid electrolyte membrane 13 disposed below the anode 11, a power supply 14 to apply a voltage between the anode 11 and a substrate B that is disposed below the solid electrolyte membrane 13 and serves as a cathode, and an upper casing (liquid reservoir) 15 that holds the anode 11 and the solid electrolyte membrane 13 while separating them away from each other, the upper casing storing electrolyte solution L containing metal ions between the anode 11 and the solid electrolyte membrane 13. As shown in FIGS. 1 to 3, the solid electrolyte membrane 13 is placed between the anode 11 and the substrate B. For convenience of explanation, the present embodiment specifies the positional relationship of the components of the film formation apparatus 1 assuming that the solid electrolyte membrane 13 is placed below the anode 11 and the substrate B is then placed below the solid electrolyte membrane 13. However, the positional relationship is not limited to this as long as a metal film F can be deposited on the surface of the substrate B. For example, the top and bottom of the film formation apparatus may be inverted in FIG. 1.

As shown in FIG. 3, the film formation apparatus 1 is configured to apply a voltage between the anode 11 and the substrate B after bringing the solid electrolyte membrane 13 into contact with the substrate B from the above, so as to reduce metal ions contained in the solid electrolyte membrane 13 for metal deposition, thus forming a metal film F that is the metal deposit on the surface of the substrate B.

The substrate B is not particularly limited in material as long as it functions as a cathode (that is, a surface having conductivity), and may be made of a metal material such as aluminum or iron or may be made of resins or ceramics coated with a metal layer such as copper, nickel, silver, or iron.

As shown in FIGS. 1 to 3, the film formation apparatus 1 includes a lower casing 21, on which the substrate B is mounted. The lower casing 21 is made of a conductive material (e.g., metal). The negative electrode of the power supply 14 is connected to the lower casing 21 via conducting wire. This means that the substrate B is electrically connected to the negative electrode of the power supply 14 via the lower casing 21 and the conducting wire. Note here that the lower casing 21 may be made of a non-conductive material. In this case, the substrate B is directly connected to conducting wire passing through the lower casing 21, and is electrically connected to the negative electrode of the power supply 14 via this conducting wire.

As shown in FIGS. 1 to 3, the anode 11 has a shape corresponding to the film formation region of the substrate B. The film formation region of the substrate B means a portion of the surface of the substrate B that faces the anode 11. The anode 11 is a non-porous (for example, without pores) anode made of the same metal as that of the metal film F, and has a block shape or flat plate-shape. Examples of the material of the anode 11 include copper, nickel, silver, and iron. The present embodiment is configured to dissolve the anode 11 by applying a voltage from the power supply 14. In another example, a film may be formed only with the electrolyte solution L containing metal ions. In this case, the anode 11 may not be dissolved. The anode 11 may be a porous body, and in some embodiments, it is a non-porous material. The non-porous anode 11 allows the metal film F formed on the substrate B to be less susceptible to the surface condition of the anode 11.

The anode 11 is attached to the upper casing 15 made of a conductive material (e.g., metal). The positive electrode of the power supply 14 is connected to the upper casing 15 via conducting wire. This means that the anode 11 is electrically connected to the positive electrode of the power supply 14 via the upper casing 15 and the conducting wire. Note here that the upper casing 15 may be made of a non-conductive material. In this case, the anode 11 is directly connected to conducting wire passing through the upper casing 15, and is electrically connected to the positive electrode of the power supply 14 via this conducting wire.

As stated above, the electrolyte solution L is liquid containing the metal of the metal film F to be formed in an ionic state, and examples of the metal include copper, nickel, silver and iron. The electrolyte solution L is an aqueous solution (ionization) of these metals with an acid, such as nitric acid, phosphoric acid, succinic acid, nickel sulfate, or pyrophosphoric acid. For example, when the metal is nickel, the electrolyte solution L may be an aqueous solution of nickel nitrate, nickel phosphate, nickel succinate, nickel sulfate, or nickel pyrophosphate.

When being brought into contact with the electrolyte solution L as stated above, the solid electrolyte membrane 13 is impregnated with (contains) metal ions. The solid electrolyte membrane 13 is not limited as long as the metal ions are reduced at the substrate B when a voltage is applied from the power supply 14 and metal derived from the metal ions is deposited. The material of the solid electrolyte membrane 13 may be resins having an ion exchange function, and examples include fluorine-based resin, such as Nafion (registered trademark) manufactured by DuPont, hydrocarbon resin, polyamic acid resin, and Selemion (CMV, CMD, CMF series) manufactured by Asahi Glass Co. As shown in FIGS. 1 to 3, the solid electrolyte membrane 13 includes a central portion 13*a*, which is a portion in contact with of the film formation region of the substrate B and the electrolyte solution L, and an outer edge portion 13*b* located outside the central portion 13*a*. The outer edge portion 13*b* of the solid electrolyte membrane 13 includes an upper protrusion 13*d* including the tip end of the outer edge portion 13*b* that is bent upward when the solid electrolyte membrane 13 is attached to the upper casing 15.

As shown in FIGS. 1 to 3, the upper casing 15 includes a body 15*a* and a lower protrusion 15*b*. As shown in FIG. 1, the anode 11 and the solid electrolyte membrane 13 are attached to upper casing 15, and the upper casing 15, the anode 11, and the solid electrolyte membrane 13 form a storage space S that stores the electrolyte solution L.

The body 15*a* has a rectangular cross section that surrounds the anode 11. The body 15*a* is placed around the anode 11, and has an inner side face, to which the anode 11 is attached. The body 15*a* has a supply channel 16 to supply electrolyte solution L to the storage space S and a discharge channel 17 to discharge electrolyte solution L from the storage space S. These supply channel 16 and discharge channel 17 are holes that penetrate through the body 15*a* in the left-right direction. The supply channel 16 is fluidly connected to a supply pipe 50 described below, and the discharge channel 17 is fluidly connected to a discharge pipe 52 described below. The film formation apparatus 1 is provided with a heater (not shown) upstream of the supply channel 16 (for example, in a tank T storing the electrolyte solution L), and the electrolyte solution L heated by this heater is supplied to the storage space S via the supply channel 16.

As shown in FIGS. 1 to 3, the lower protrusion 15*b* extends downward from the lower face 15*al* of the body 15*a*. The lower protrusion 15*b* has an outer side face 15*b*1 facing outward. The storage space S is open downward, and the solid electrolyte membrane 13 is attached to the lower face 15*c* of the lower protrusion 15*b* in the upper casing 15 via a sealing member (not shown) so as to seal the storage space S storing the electrolyte solution L therein. The anode 11 and the solid electrolyte membrane 13 are placed away from each other in a non-contact state, and the space between them is filled with the electrolyte solution L. In this way, the upper casing 15 is configured so that the electrolyte solution L stored in the storage space S is in direct contact with the anode 11 and the solid electrolyte membrane 13. The upper casing 15 is made of a material that is insoluble in the electrolyte solution L.

Next, the following describes a mechanism to circulate the electrolyte solution L in the film formation apparatus 1. As shown in FIG. 1, one end of the supply pipe 50 is fluidly connected to the supply channel 16 of the upper casing 15 in the upstream portion of the film formation apparatus 1. The other end of the supply pipe 50 is connected to the tank T storing the electrolyte solution L. A pump P is interposed in the supply pipe 50, and driving the pump P pumps up the electrolyte solution L from the tank T into the supply pipe 50 and feeds the electrolyte solution L into the storage space S of the upper casing 15 under pressure. In the downstream portion of the film formation apparatus 1, one end of the discharge pipe 52 is fluidly connected to the discharge channel 17 of the upper casing 15. The other end of the discharge pipe 52 is connected to the tank T. A pressure regulation valve 54 is interposed in the discharge pipe 52. The pressure regulation valve 54 prevents the pressure (liquid pressure) of the electrolyte solution L stored in the storage space S from exceeding a predetermined pressure and keeps the sealing state of the storage space S at a pressure equal to or lower than the predetermined pressure. This circulation mechanism allows the electrolyte solution L, whose concentration of metal ions is adjusted to a predetermined level, to be supplied to the storage space S from the supply channel 16, and the electrolyte solution L used in the storage space S during film formation to return to the tank T via the discharge channel 17.

In this embodiment, the film formation apparatus 1 includes an elevating mechanism, not shown, above the upper casing 15. Examples of the elevating mechanism include a cylinder of a hydraulic type or a pneumatic type, which enables the solid electrolyte membrane 13 to move up and down to bring the solid electrolyte membrane 13 into contact with and separate it from the substrate B. The elevating mechanism to bring the solid electrolyte membrane 13 into contact with and separate it from the substrate B may be placed below the lower casing 21. In this case, the substrate B may be moved up and down to bring the solid electrolyte membrane 13 into contact with and separate it from the substrate B.

As shown in FIGS. 1 to 3, the film formation apparatus 1 includes a membrane tensioning unit (membrane tensioning mechanism) 18 that applies a tensile force to the central portion 13*a* of the solid electrolyte membrane 13 from the central portion 13*a* toward the outer edge portion 13*b*, with the heated electrolyte solution L stored in the upper casing 15, to elongate the central portion 13*a* of the solid electrolyte membrane 13. The membrane tensioning unit 18 includes at least a frame 18*a* and an electric motor (tensioning device) M. The membrane tensioning unit 18 further includes a lateral protrusion 18*b* that is a portion having a rectangular cross section extending outward from the frame 18*a*.

Specifically, as shown in FIGS. 1 to 3, the frame 18*a* has a rectangular cross section placed to surround the solid electrolyte membrane 13 and has an inner side face 18*d* facing the solid electrolyte membrane 13 (i.e., facing inward). The frame 18*a* is configured to sandwich the outer edge portion 13*b* of the solid electrolyte membrane 13, which is bent along the outer side face 15*b*1 of the upper casing 15, between it and the outer side face 15*b*1. That is, the solid electrolyte membrane 13 is attached to the upper casing 15 so that the upper protrusion 13*d* of the outer edge portion 13*b* is sandwiched between the outer side face 15*b*1 of the upper casing 15 and the inner side face 18*d* of the frame 18*a*.

As shown in FIG. 1, the space defined by the upper face 18*e* of the frame 18*a*, the outer side face 15*b*1 of the lower protrusion 15*b*, and the lower face 15*al* of the body 15*a* stores a spacer 30. The spacer 30 restricts the upward movement of the frame 18*a*. As shown in FIGS. 1 to 3, any actuator such as an electric motor (not shown) may be used to insert and remove the spacer 30 in the space defined by the upper face 18*c* of the frame 18*a*, the outer side face 15*b*1 of the lower protrusion 15*b*, and the lower face 15*al* of the body 15*a*.

As shown in FIG. 3, the electric motor M acts on the lateral protrusion 18*b* of the membrane tensioning unit 18 to vertically move the frame 18*a*. Specifically, the electric motor M slides the frame 18*a* upward along the outer side face 15*b*1 of the lower protrusion 15*b*. As a result, the upper protrusion 13*d* is lifted upward by the frictional force with the inner side face 18*d* of the frame 18*a*, to apply a tensile force to the central portion 13*a* of the solid electrolyte membrane 13 and elongate the central portion 13*a*. The electric motor M may act on the frame 18*a* of the membrane tensioning unit 18 to vertically move the frame 18*a*.

As shown in FIGS. 1 to 3, the film formation apparatus 1 includes a first temperature sensor 42, a second temperature sensor 44, a third temperature sensor 46, and a controller 40. In one example, the first temperature sensor 42 is attached to the body 15*a* of the upper casing 15, and detects the temperature (the first temperature) of the solid electrolyte membrane 13 through the body 15*a*. The first temperature sensor 42 transmits the detected first temperature information to the controller 40. The first temperature sensor 42 may be attached to a member with which the solid electrolyte membrane 13 is in contact, and may be attached to, for example, the frame 18*a*. In one example, the second temperature sensor 44 is attached to the lower casing 21, and detects the temperature (the second temperature) of the substrate B through the lower casing 21. The second temperature sensor 44 transmits the detected second temperature information to the controller 40. In one example, the third temperature sensor 46 is attached to the tank T, and detects the temperature (the third temperature) of the electrolyte solution L through the tank T. The third temperature sensor 46 transmits the detected third temperature information to the controller 40.

The controller 40 operates the above-mentioned elevating mechanism (not shown) so that the solid electrolyte membrane 13 comes into contact with the substrate B, and then controls the operation of the pump P to supply the heated electrolyte solution L in the upper casing 15 (storage space S). The controller 40 controls to fill the storage space S with the heated electrolyte solution L first, and then operate the membrane tensioning unit 18. An operation timing of the membrane tensioning unit 18 is shown below.

As shown in FIGS. 2 and 3, the controller 40 receives the first temperature information from the first temperature sensor 42, the second temperature information from the second temperature sensor 44, and the third temperature information from the third temperature sensor 46 when the upper casing 15 stores the electrolyte solution L, and controls the membrane tensioning unit 18 to operate if the first temperature information, the second temperature information, and the third temperature information are within a predetermined range. Specifically, when the first, second, and third temperature information is within the predetermined range, the controller 40 transmits a drive signal to the electric motor M and controls the electric motor M to drive the frame 18*a* to move upward. The predetermined range of the first, second, and third temperature information means the range where further sagging of the solid electrolyte membrane is unlikely to occur due to the temperature difference between the solid electrolyte membrane, substrate, and electrolyte solution.

Next, the film formation method using the film formation apparatus 1 according to the present embodiment will be described. The film formation method according to the present embodiment applies a voltage between the anode 11 and the substrate B serving as a cathode while pressing the substrate B with the solid electrolyte membrane 13 under liquid pressure of the electrolyte solution L so as to reduce metal ions contained in the solid electrolyte membrane 13, thus forming a metal film F on the surface of the substrate B.

As shown in FIG. 1, the film formation method according to the present embodiment places the substrate B on the lower casing 21, aligns the substrate B relative to the anode 11 attached to the upper casing 15, and regulates the temperature of the substrate B. The method then attaches the solid electrolyte membrane 13 on the lower face 15*e* of the lower protrusion 15*b* in the upper casing 15 via a sealing member (not shown) while sandwiching the upper protrusion 13*d* of the outer edge portion 13*b* in the solid electrolyte membrane 13 between the outer side face 15*b*1 of the upper casing 15 and the inner side face 18*d* of the frame 18*a*. The method then inserts the spacer 30 into the space defined by the upper face 18*c* of the frame 18*a*, the outer side face 15*b*1 of the lower protrusion 15*b*, and the lower face 15*al* of the body 15*a*, as shown in FIG. 1.

Next, as shown in FIG. 2, the method performs a step of bringing the solid electrolyte membrane 13 into contact with the surface of the substrate B. This step uses the elevating mechanism (not shown) to move the upper casing 15 downward so as to bring the solid electrolyte membrane 13 into contact with the substrate B from above. Alternatively, this step uses the elevating mechanism (not shown) to move the lower casing 21 upward so as to bring the substrate B into contact with the lower face of the solid electrolyte membrane 13.

Next, as shown in FIG. 2, the method performs a step of storing heated electrolyte solution L in the space between the anode 11 and the solid electrolyte membrane 13. This step fills the storage space S in the upper casing 15 with the electrolyte solution L from the tank T using the pump P. At this step, the electrolyte solution L is heated, so that the central portion 13*a* of the solid electrolyte membrane 13 thermally expands. This causes the central portion 13*a* of the solid electrolyte membrane 13 to sag against the substrate B. Then, the method uses any actuator such as an electric motor (not shown) to remove the spacer 30 from the space defined by the upper face 18*c* of the frame 18*a*, the outer side face 15*b*1 of the lower protrusion 15*b*, and the lower face 15*a*1 of the body 15*a*.

Next, as shown in FIG. 3, in which the electrolyte solution L is stored in the storage space S of the upper casing 15, the method performs a step of stretching the solid electrolyte membrane 13. That is, the step applies a tensile force to the central portion 13*a* of the solid electrolyte membrane 13 in the direction from the central portion 13*a* to the outer edge portion 13*b* so as to elongate the central portion 13*a* of the solid electrolyte membrane 13. Specifically, this step of stretching the solid electrolyte membrane 13 sandwiches the outer edge portion 13*b*, which is bent along the outer side face 15*b*1 of the upper casing 15, between the frame 18*a* disposed to at least partially surround the outer edge portion 13*b* and the outer side face 15*b*1, and slides the frame 18*a* upward along the outer side face 15*b*1 by the driving force of the electric motor M to apply a tensile force to the central portion 13*a*. This eliminates the sag in the central portion 13*a* of the solid electrolyte membrane 13.

Alternatively, if the temperature of the solid electrolyte membrane 13, the temperature of the substrate B, and the temperature of the electrolyte solution L stored between the anode 11 and the solid electrolyte membrane 13 are within a predetermined range, this step of stretching the solid electrolyte membrane may slide the frame 18*a* upward by the electric motor M in response to a driving signal from the controller 40 to apply a tensile force to the central portion 13*a*. This allows for more reliable elimination of sagging in the central portion 13*a* of the solid electrolyte membrane 13.

Next, as shown in FIG. 3, the method performs a step of applying a voltage between the anode 11 and the substrate B while pressing the substrate B with the stretched solid electrolyte membrane 13 under the liquid pressure of the electrolyte solution L stored in the storage space S, thus forming a metal film F. Specifically, the step increases the liquid pressure of the electrolyte solution L in the storage space S to a predetermined pressure with the pump P and the pressure regulation valve 54, and presses the substrate B with the solid electrolyte membrane 13 under the liquid pressure of the electrolyte solution L. In such a state, the step applies a voltage between the anode 11 and the substrate B from the power supply 14. This causes metal ions contained in the solid electrolyte membrane 13 to move to the surface of the substrate B in contact with the solid electrolyte membrane 13 and be reduced on the surface of the substrate B. As a result, metal is deposited on the surface of the substrate B, and a metal film F is formed on the surface of the substrate B. At this step, the storage space S contains the electrolyte solution L, which allows the metal ions to be constantly supplied to the solid electrolyte membrane 13. When the formation of the metal film F is completed, the step stops application of the voltage from the power supply 14. Next, the step stops pumping of the electrolyte solution L by the pump P, and then returns the electrolyte solution L in the storage space S to the tank T. Then the step separates the substrate B and the solid electrolyte membrane 13 from each other using the elevating mechanism. The step then inserts the spacer 30 into the space between the upper casing 15 and the frame 18*a*.

The following describes the advantageous effects of the film formation apparatus 1 according to the present embodiment and the film formation method using this film formation apparatus 1.

As described above, the film formation apparatus 1 according to the present embodiment stores the heated electrolyte solution L in the upper casing 15, and the membrane tensioning unit 18 of the film formation apparatus 1 then applies a tensile force to the central portion 13*a* of the solid electrolyte membrane 13 from the central portion 13*a* toward the outer edge portion 13*b* to elongate the central portion 13*a* of the solid electrolyte membrane 13. The film formation method according to the present embodiment includes the step of, while storing the electrolyte solution L, stretching the solid electrolyte membrane 13 by applying a tensile force to the central portion 13*a* of the solid electrolyte membrane 13 in the direction from the central portion 13*a* to the outer edge portion 13*b* so as to elongate the central portion 13*a*. Therefore, even when the solid electrolyte membrane 13 thermally expands due to heated electrolyte solution L poured into the upper casing 15, which causes sagging of the solid electrolyte membrane 13 against the surface of the substrate B, the tensile force applied to the central portion 13*a* toward the outer edge portion 13*b* elongates the central portion 13*a* of the solid electrolyte membrane 13. In this way, the present embodiment applies a voltage between the anode 11 and the substrate B after eliminating the sagging of the solid electrolyte membrane 13, that is, while keeping the solid electrolyte membrane 13 flat. This suppresses unevenness in the metal film F deposited on the surface of the substrate B, and thereby suppresses fluctuations in film thickness of the metal film F.

As described above, the membrane tensioning unit 18 at least includes the frame 18*a* that sandwiches the outer edge portion 13*b*, which is bent along the outer side face 15*b*1 of the upper casing 15, between it and the outer side face 15*b*1, and the electric motor M that slides the frame 18*a* along the outer side face 15*b*1 to apply a tensile force to the central portion 13*a*. The step of stretching the solid electrolyte membrane 13 sandwiches the outer edge portion 13*b*, which is bent along the outer side face 15*b*1 of the upper casing 15, between the frame 18*a* and the outer side face 15*b*1, and slides the frame 18*a* along the outer side face 15*b*1 to apply a tensile force to the central portion 13*a*. Therefore, when the frame 18*a* is slid along the outer side face 15*b*1, the outer edge portion 13*b* of the solid electrolyte membrane 13 moves uniformly by the frictional force with the frame 18*a*. Accordingly, an isotropic tensile force acts on the central portion 13*a* of the solid electrolyte membrane 13, stretching the central portion 13*a* outward, which elongates the central portion 13*a* more uniformly. This forms a smooth metal film F because a voltage can be applied between the anode 11 and the substrate B after correcting the sagging in the solid electrolyte membrane 13 due to thermal expansion.

The film formation apparatus 1 according to the present embodiment includes the controller 40 that receives the first temperature information from the first temperature sensor 42, the second temperature information from the second temperature sensor 44, and the third temperature information from the third temperature sensor 46 when the upper casing 15 stores the electrolyte solution L, and controls the membrane tensioning unit 18 to operate if the first temperature information, the second temperature information, and the third temperature information are within a predetermined range. The film formation method according to the present embodiment includes the step of stretching the solid electrolyte membrane 13, and if the temperature of the solid electrolyte membrane 13, the temperature of the substrate B, and the temperature of the electrolyte solution L stored between the anode 11 and the solid electrolyte membrane 13 are within a predetermined range, this step applies the tensile force to the central portion. Therefore, even when the solid electrolyte membrane 13 sags due to thermal expansion, if the temperatures of the solid electrolyte membrane 13, the substrate B, and the electrolyte solution L are within a predetermined range, the step applies a tensile force to the central portion 13*a* of the solid electrolyte membrane 13 toward the outer edge portion 13*b* to elongate the central portion 13*a* of the solid electrolyte membrane 13. In this way, when the temperature difference between the solid electrolyte membrane 13, the substrate B, and the electrolyte solution L becomes small or when they have no temperature difference, in other words, when it is determined that additional sagging of the solid electrolyte membrane 13 is unlikely to occur due to such a temperature difference, the step elongates the central portion 13*a* of the solid electrolyte membrane 13. This allows a smoother metal film F to be formed because a voltage can be applied between the anode 11 and the substrate B after ensuring the correction of the sagging in the solid electrolyte membrane 13 due to thermal expansion.

Second Embodiment

Figure 4:
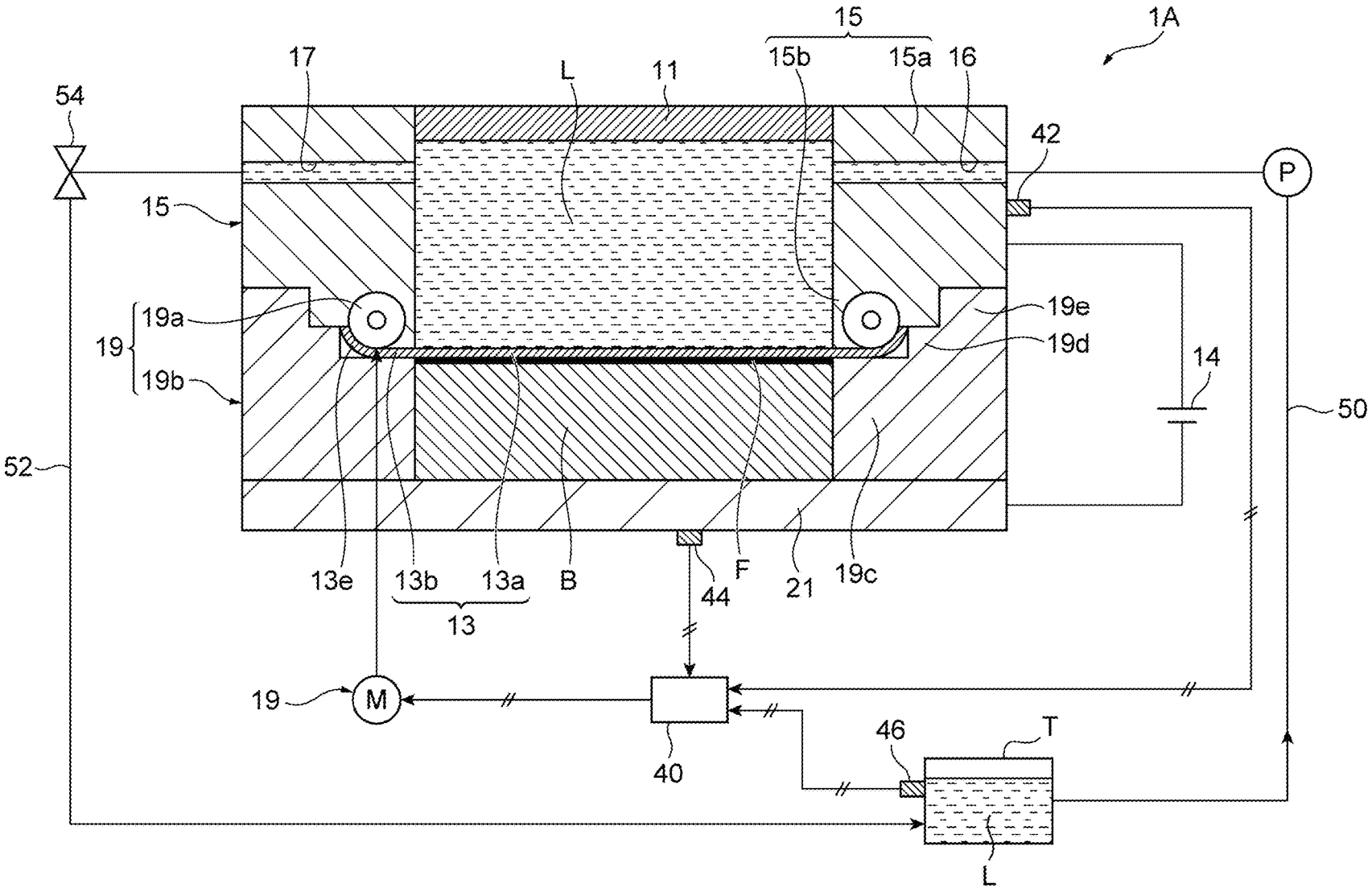
FIG. 4 is a schematic cross-sectional view of a film formation apparatus of metal film according to a second embodiment of the present disclosure, showing the solid electrolyte membrane stretched outward.

FIG. 4 is a schematic cross-sectional view of a film formation apparatus 1A to form a metal film F according to a second embodiment of the present disclosure, showing the solid electrolyte membrane 13 stretched outward. The film formation apparatus 1A according to the second embodiment differs from the film formation apparatus 1 according to the first embodiment in the configuration of the membrane tensioning unit 19 that is a membrane tensioning mechanism. The following describes different parts from the first embodiment, and like numbers indicate like components as in the film formation apparatus 1 according to the first embodiment to omit their descriptions.

As shown in FIG. 4, the membrane tensioning unit (membrane tensioning mechanism) 19 includes at least a rotary drum 19*a* as a winder and an electric motor M as a tensioning device. The membrane tensioning unit 19 further includes a clamp 19*b* located below the upper casing 15.

In one example, the rotary drum 19*a* is a cylindrical member, and is attached to the lower protrusion 15*b* of the upper casing 15 so that at least a part of the outer peripheral surface is exposed. In the present embodiment, a part of the outer peripheral surface of the rotary drum 19*a* is exposed from the lower protrusion 15*b*, and the other part is housed inside the lower protrusion 15*b*. The rotary drum 19*a* has the outer peripheral surface exposed from the lower protrusion 15*b*, around which the outer edge portion 13*b* of the solid electrolyte membrane 13 is partially wound. The outer edge portion 13*b* of the solid electrolyte membrane 13 includes a wound portion 13*e*, which is wound around the rotary drum 19*a*.

As shown in FIG. 4, the clamp 19*b* has a bottom 19*c* having a rectangular cross section and placed to surround the substrate B, and a first step 19*d* and a second step 19*e* on the top face of the bottom 19*c*. The clamp 19*b* is placed on the lower casing 21, and sandwiches the outer edge portion 13*b* of the solid electrolyte membrane 13 between the bottom 19*c* and the rotary drum 19*a*. The first and second steps 19*d* and 19*e* of the clamp 19*b* are shaped to fit into the upper casing 15. The shapes of the first and second steps 19*d* and 19*e* are not limited to this, and may have any shape as long as it does not prevent the solid electrolyte membrane 13 from being sandwiched between the bottom 19*c* and the rotary drum 19*a*.

As shown in FIG. 4, the electric motor M acts on the rotary drum 19*a* to rotate it in a given direction. Specifically, the electric motor M rotates the rotary drum 19*a* while keeping the outer edge portion 13*b* into contact with the rotary drum 19*a*. The frictional force with the rotary drum 19*a* causes the wound portion 13*e* to be stretched outward, applying a tensile force to the central portion 13*a* of the solid electrolyte membrane 13, and elongating the central portion 13*a*. This embodiment describes the configuration of the outer edge portion 13*b* of the solid electrolyte membrane 13 being pressed against the rotary drum 19*a* by the bottom 19*c* of the clamp 19*b*. In another embodiment, the outer edge portion 13*b* of the solid electrolyte membrane 13 may be attached to the rotary drum 19*a* by adhesion.

The film formation method according to the present disclosure includes the step of stretching the solid electrolyte membrane 13, and this step rotates the rotary drum 19*a* by the driving force of the electric motor M while keeping the outer edge portion 13*b* into contact with the rotary drum 19*a*, around which the outer edge portion 13*b* is partially wound, thus acting a tensile force on the central portion 13*a*.

As described above, the membrane tensioning unit 19 according to the present embodiment at least includes the rotary drum 19*a*, around which the outer edge portion 13*b* of the solid electrolyte membrane 13 is partially wound, and the electric motor M that rotates the rotary drum 19*a* while keeping the outer edge portion 13*b* into contact with the rotary drum 19*a*, thus applying a tensile force to the central portion 13*a*. The film formation method according to the present disclosure includes the step of stretching the solid electrolyte membrane 13, and this step rotates the rotary drum 19*a* by the driving force of the electric motor M while keeping the outer edge portion 13*b* into contact with the rotary drum 19*a*, around which the outer edge portion 13*b* is partially wound, thus applying a tensile force to the central portion 13*a*. The rotation of the rotary drum 19*a* therefore winds the outer edge portion 13*b* of the solid electrolyte membrane 13 partially around the rotary drum 19*a* due to the frictional force with the rotary drum 19*a*. This causes the central portion 13*a* of the solid electrolyte membrane 13 to be stretched outward for elongation. This forms a smooth metal film F because a voltage can be applied between the anode 11 and the substrate B after correcting the sagging in the solid electrolyte membrane 13 due to thermal expansion.

Third Embodiment

Figure 5:
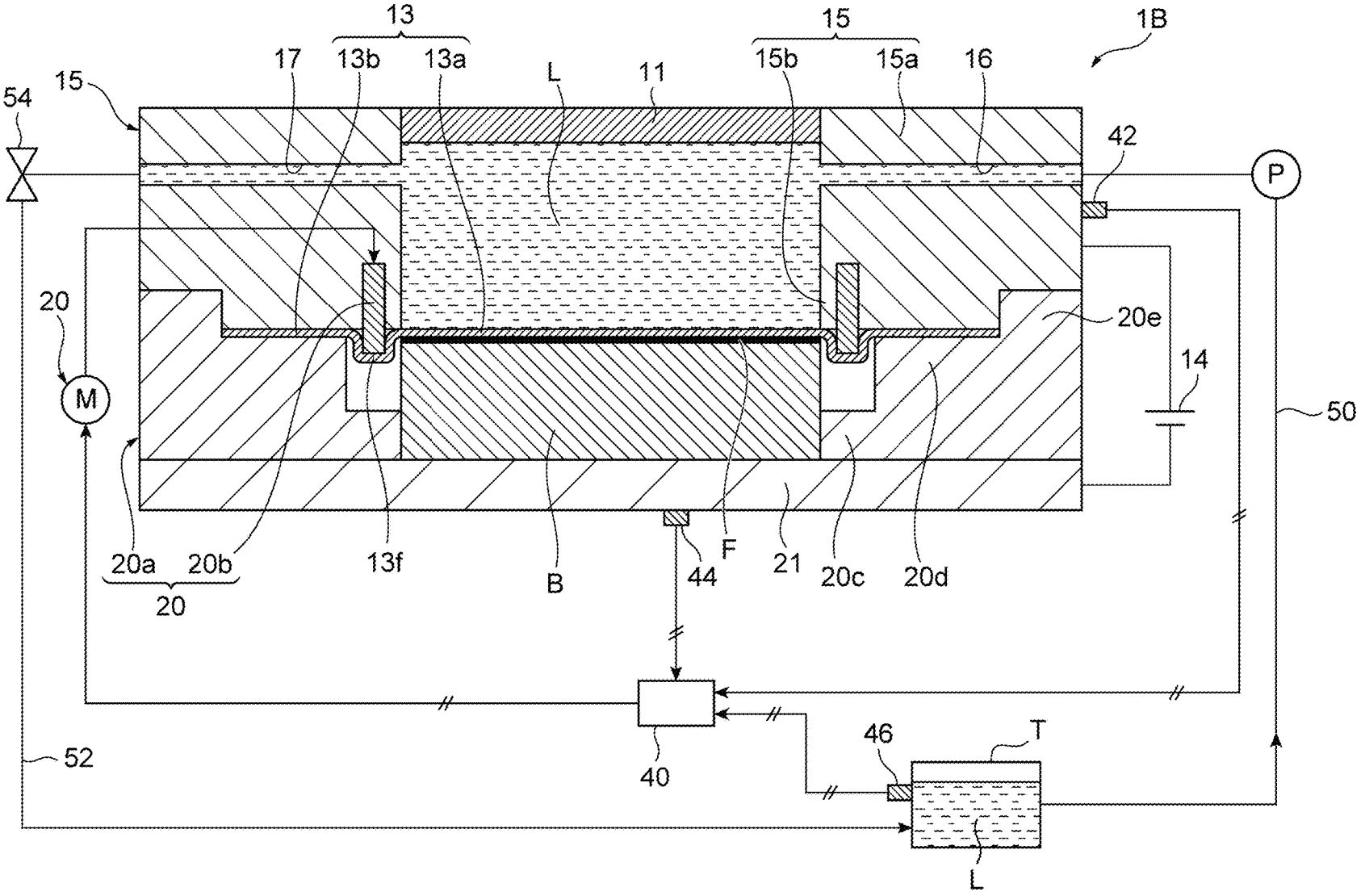
FIG. 5 is a schematic cross-sectional view of a film formation apparatus of metal film according to a third embodiment of the present disclosure, showing the solid electrolyte membrane stretched outward.

FIG. 5 is a schematic cross-sectional view of a film formation apparatus 1B to form a metal film F according to a third embodiment of the present disclosure, showing the solid electrolyte membrane 13 stretched outward. The film formation apparatus 1B according to the third embodiment differs from the film formation apparatus 1 according to the first embodiment in the configuration of the membrane tensioning unit 20 that is a membrane tensioning mechanism. The following describes different parts from the first embodiment, and like numbers indicate like components as in the film formation apparatus 1 according to the first embodiment to omit their descriptions.

As shown in FIG. 5, the membrane tensioning unit (membrane tensioning mechanism) 20 includes at least a membrane support 20*a*, a pin 20*b* that is a rod member, and an electric motor M that is a tensioning device.

As shown in FIG. 5, the membrane support 20*a* has a bottom 20*c* having a rectangular cross section and placed to surround the substrate B, and a first step 20*d* and a second step 20*e* on the top face of the bottom 20*c*. The membrane support 20*a* is placed on the lower casing 21, and supports the outer edge portion 13*b* of the solid electrolyte membrane 13 from below. Specifically, the membrane support 20*a* sandwiches the outer edge portion 13*b* of the solid electrolyte membrane 13 between the first step 20*d* and the lower protrusion 15*b* of the upper casing 15. The second step 20*e* is shaped to fit into the upper casing 15. The shape of the second step 20*e* is not limited to this, and may have any shape as long as it does not prevent the solid electrolyte membrane 13 from being sandwiched between the first step 20*d* and the upper casing 15. The membrane support 20*a* defines a predetermined space above the bottom 20*c*, which allows the pin 20*b* to push down the outer edge portion 13*b* of the solid electrolyte membrane 13.

As shown in FIG. 5, the pin 20*b* abuts on the solid electrolyte membrane 13 above the outer edge portion 13*b* and is movable in the vertical direction (film thickness direction) relative to the solid electrolyte membrane 13. Specifically, the pin 20*b* is housed inside the upper casing 15 so that at least part of it protrudes downward from the lower protrusion 15*b* of the upper casing 15. The outer edge portion 13*b* of the solid electrolyte membrane 13 includes a lower protrusion 13*f*, which is a part pressed by the pin 20*b* to bend downward.

As shown in FIG. 5, the electric motor M acts on the pin 20*b* to press the pin 20*b* downward. Specifically, the electric motor M moves the pin 20*b* downward while the outer edge portion 13*b* is supported by the membrane support 20*a*, that is, the outer edge portion 13*b* is sandwiched between the first step 20*d* and the lower protrusion 15*b*. This causes the outer edge portion 13*b* to bend downward by the pin 20*b*, and presses the lower protrusion 13*f* into the space defined above the bottom 20*c*. This applies a tensile force to the central portion 13*a* of the solid electrolyte membrane 13, and elongates the central portion 13*a*. This embodiment describes the configuration of the outer edge portion 13*b* of the solid electrolyte membrane 13 being caught by the upper casing 15 with the membrane support 20*a*. In another embodiment, a part of the outer edge portion 13*b* of the solid electrolyte membrane 13 may be attached to the upper casing 15 by adhesion.

The film formation method according to the present embodiment includes the step of stretching the solid electrolyte membrane 13, and this step moves the pin 20*b*, which is movable above the outer edge portion 13*b* in the vertical direction relative to the solid electrolyte membrane 13, downward by the driving force of the electric motor M while supporting the outer edge portion 13*b* with the membrane support 20*a* that supports the outer edge portion 13*b* from below, thus applying a tensile force to the central portion 13*a*.

As described above, the membrane tensioning unit 20 according to the present embodiment at least includes the membrane support 20*a* that supports the outer edge portion 13*b* of the solid electrolyte membrane 13 from below, the pin 20*b* that abuts on the solid electrolyte membrane 13 above the outer edge portion 13*b* and is movable in the vertical direction relative to the solid electrolyte membrane 13, and the electric motor M that moves the pin 20*b* downward while the outer edge portion 13*b* is supported by the membrane support 20*a*, thus applying a tensile force to the central portion 13*a*. The film formation method according to the present embodiment moves the pin 20*b*, which is movable above the outer edge portion 13*b* in the vertical direction relative to the solid electrolyte membrane 13, downward while supporting the outer edge portion 13*b* with the membrane support 20*a* that supports the outer edge portion 13*b* from below, thus applying a tensile force to the central portion 13*a*. This means that, when the pin 20*b* moves downward, the outer edge portion 13*b* of the solid electrolyte membrane 13 is pushed downward by the pin 20*b* while being supported by the membrane support 20*a*. This causes the central portion 13*a* of the solid electrolyte membrane 13 to be stretched outward for elongation. This forms a smooth metal film F because a voltage can be applied between the anode 11 and the substrate B after correcting the sagging in the solid electrolyte membrane 13 due to thermal expansion.

EXAMPLES

The following describes the present disclosure by way of examples.

Example 1

A glass epoxy substrate (ABF) including the layers of glass fiber cloth impregnated with epoxy resin was prepared for the substrate, on which a film is to be formed. Copper foil was formed on the surface of this glass epoxy substrate.

Next, a copper film was formed using the film formation apparatus according to the present embodiment shown in FIG. 1. For the electrolyte solution, copper sulfate aqueous solution (Cu-BRITE-SED) manufactured by JCU Corporation was used. For the anode, a Cu plate was used. The copper film was formed under the conditions: the distance between the anode and the substrate as the cathode was 2 mm, the temperature of the electrolyte solution was 42° C., the solid electrolyte membrane (Nafion (manufactured by DuPont)) of 8 μm in thickness was brought into close contact with the substrate, the liquid pressure of the electrolyte solution was 0.6 MPa, the current density was 7 A/dm$^2$, the film formation area was 100 cm$^2$, and the cumulative film-formation time was 388 seconds.

Comparative Example 1

The film was formed similarly to Example 1. The difference from Example 1 is that a copper film was formed using a film formation apparatus that did not have a membrane tensioning unit 18 as a membrane tensioning mechanism.

<Confirmation of Film Formed>

Figure 6:
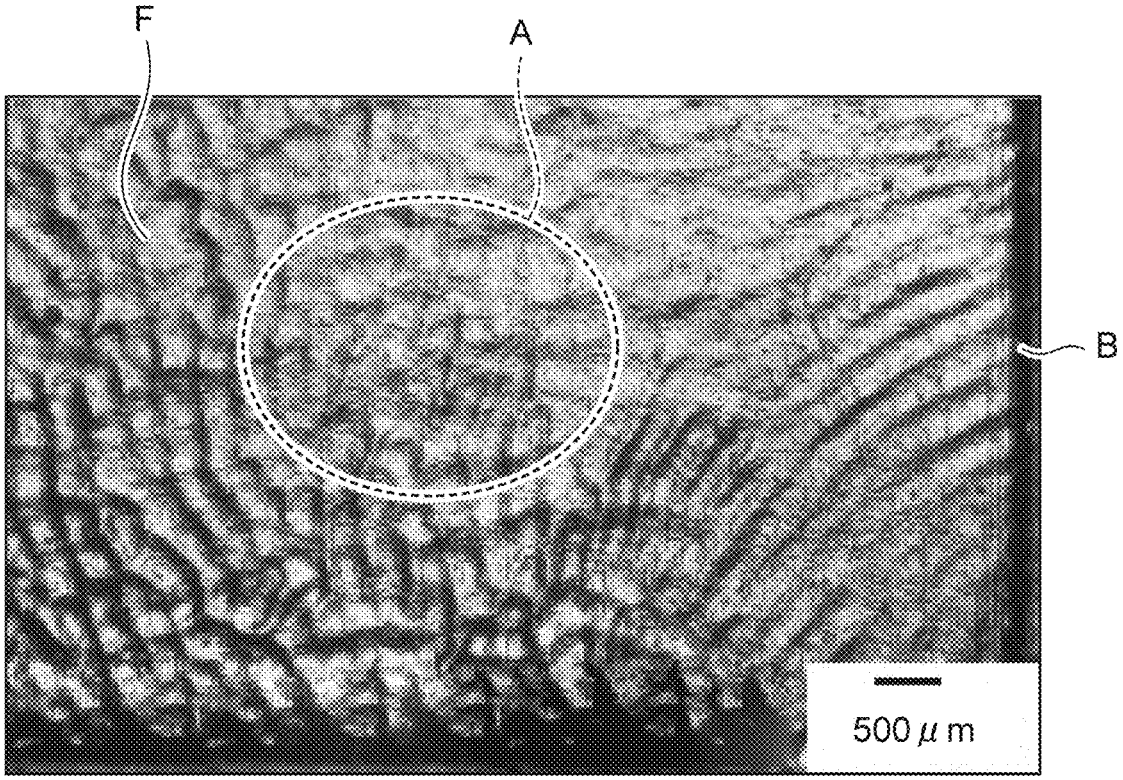
FIG. 6 is an image obtained by observing the unevenness of the metal film formed on the surface of the substrate with a scanning microscope.
Figure 7:
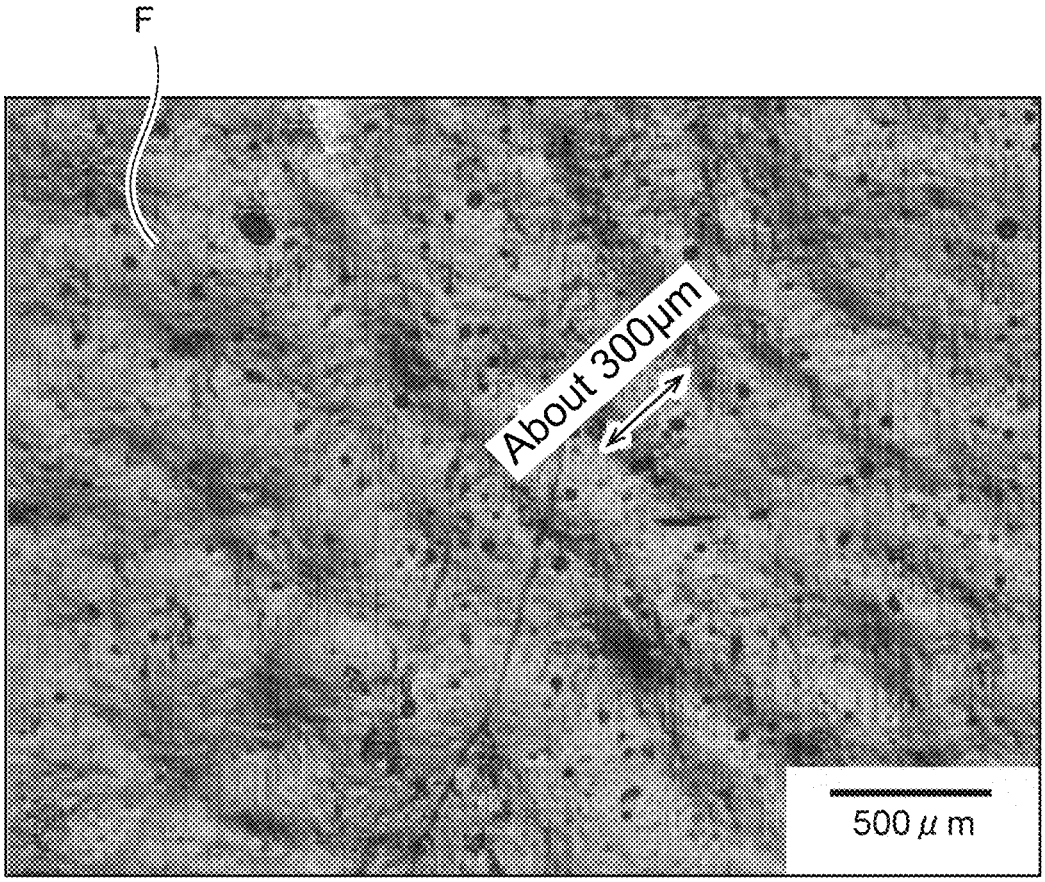
FIG. 7 is an enlarged view of part A in FIG. 6.

The substrates with the film formed as described above were observed with a scanning microscope, about the presence or not of unevenness of the metal film. FIG. 6 is an image obtained by observing the unevenness of the metal film formed on the surface of the substrate in Comparative Example 1 with a scanning microscope. FIG. 7 is an enlarged view of part A in FIG. 6. Table 1 (Example 1) and Table 2 (Comparative Example 1) show the result.

TABLE 1

| Sample No. | Sag occurred | Evaluation |
|---|---|---|
| 1 | No | Good |
| 2 | No | Good |
| 3 | No | Good |
| 4 | No | Good |

TABLE 2

| Sample No. | Sag occurred | Evaluation |
|---|---|---|
| 1 | Yes | Bad |
| 2 | Yes | Bad |
| 3 | Yes | Bad |
| 4 | Yes | Bad |

(Results and Consideration)

As is clear from Table 1, no unevenness was observed in all the points inspected of Example 1. Therefore, it is considered that, even when the electrolyte solution heated to 42° C. was poured into the upper casing, the film was formed while eliminating the sagging of the solid electrolyte membrane 13 due to thermal expansion. Presumably, the film was formed while keeping the solid electrolyte membrane flatter, because a tensile force was applied to the central portion of the solid electrolyte membrane toward the outer edge portion to elongate the central portion of the solid electrolyte membrane. Presumably, this suppressed the unevenness of the metal film formed on the surface of the substrate, and formed the metal film with less fluctuation in film thickness.

In contrast, Table 2 clearly shows that unevenness was observed in all inspected points in Comparative Example 1. Presumably, after the electrolyte solution heated to 42° C. was poured into the upper casing, the film was formed without eliminating the sagging of the solid electrolyte membrane due to the heated electrolyte solution.

That is descriptions on some embodiments of the present disclosure. The present disclosure is not limited to the film formation apparatuses 1, 1A, and 1B according to the above embodiments but includes all configurations included in the concept and claims of the disclosure. The configurations may be selectively combined as appropriate so as to cope with the above-mentioned problems and achieve advantageous effects. For example, the shape, material, arrangement, size, etc. of each component in the above embodiments can be appropriately changed depending on the specific embodiment of the present disclosure.

What is claimed is:

1. A film formation apparatus for forming a metal film, comprising:

an anode;

a solid electrolyte membrane disposed between the anode and a substrate;

a power supply that applies a voltage between the anode and the substrate serving as a cathode; and a liquid reservoir that holds the anode and the solid electrolyte membrane while separating the anode and the solid electrolyte membrane apart from each other, the liquid reservoir storing an electrolyte solution comprising metal ions between the anode and the solid electrolyte membrane, the film formation apparatus being configured to apply a voltage between the anode and the substrate while allowing the solid electrolyte membrane to be in contact with the substrate to reduce the metal ions in the solid electrolyte membrane, and form the metal film on a surface of the substrate, wherein, the solid electrolyte membrane comprises a central portion, which is a portion that comes into contact with the substrate and the electrolyte solution, and an outer edge portion located outside the central portion, the film formation apparatus further comprises a membrane tensioning mechanism configured to apply a tensile force from the central portion toward the outer edge portion while storing the electrolyte solution in the liquid reservoir, to elongate the central portion of the solid electrolyte membrane.

2. The film formation apparatus for forming a metal film according to claim 1, wherein the membrane tensioning mechanism at least comprises: a frame that sandwiches the outer edge portion, which is bent along an outer side face of the liquid reservoir, with the outer side face; and a tensioning device configured to slide the frame along the outer side face so as to apply the tensile force to the central portion.

3. The film formation apparatus for forming a metal film according to claim 1, wherein the membrane tensioning mechanism at least comprises: a winder, around which the outer edge portion of the solid electrolyte membrane is partially wound; and a tensioning device configured to rotate the winder while allowing the outer edge portion to be in contact with the winder so as to apply the tensile force to the central portion.

4. The film formation apparatus for forming a metal film according to claim 1, wherein the membrane tensioning mechanism at least comprises: a membrane support that supports the outer edge portion of the solid electrolyte membrane; a rod member that abuts on the outer edge portion and is movable in the film thickness direction of the solid electrolyte membrane relative to the solid electrolyte membrane; and a tensioning device configured to move the rod member in the film thickness direction while the outer edge portion is supported by the membrane support, thus applying the tensile force to the central portion.

5. The film formation apparatus for forming a metal film according to claim 1, further comprising:

a first temperature sensor that detects a first temperature of the solid electrolyte membrane;

a second temperature sensor that detects a second temperature of the substrate;

a third temperature sensor that detects a third temperature of the electrolyte solution; and a controller programmed to receive the first temperature information from the first temperature sensor, the second temperature information from the second temperature sensor, and the third temperature information from the third temperature sensor when the liquid reservoir stores the electrolyte solution, and control the membrane tensioning mechanism to operate if the first temperature information, the second temperature information, and the third temperature information are within a predetermined range.

* * * * *